US009593547B2

(12) United States Patent
Malcolm et al.

(10) Patent No.: US 9,593,547 B2
(45) Date of Patent: Mar. 14, 2017

(54) DOWNHOLE SHOCK ASSEMBLY AND METHOD OF USING SAME

(71) Applicant: NATIONAL OILWELL DHT, L.P., Houston, TX (US)

(72) Inventors: Andrew D. Malcolm, Edmonton (CA); Roman Kvasnytsia, Edmonton (CA); Justin Lockhart, Sherwood Park (CA)

(73) Assignee: National Oilwell DHT, L.P., Houston, TX (US)

( * ) Notice: Subject to any disclaimer, the term of this patent is extended or adjusted under 35 U.S.C. 154(b) by 783 days.

(21) Appl. No.: 13/954,793

(22) Filed: Jul. 30, 2013

(65) Prior Publication Data

US 2015/0034387 A1 Feb. 5, 2015

(51) Int. Cl.
*E21B 28/00* (2006.01)

(52) U.S. Cl.
CPC ..... *E21B 28/00* (2013.01)

(58) Field of Classification Search
CPC ..... E21B 7/24; E21B 28/00; E21B 31/005; E21B 31/113; E21B 31/1135
See application file for complete search history.

(56) References Cited

U.S. PATENT DOCUMENTS

| | | | |
|---|---|---|---|
| 1,821,212 | A | 9/1931 | Granger |
| 2,554,005 | A | 5/1951 | Bodine, Jr. |
| 2,613,917 | A | 10/1952 | Postlewaite |
| 3,807,512 | A | 4/1974 | Pogonowski et al. |
| 4,011,917 | A | 3/1977 | Tiraspolsky et al. |
| 4,428,443 | A | 1/1984 | Oliphant |
| 4,434,859 | A | 3/1984 | Rumpp et al. |
| 4,986,357 | A | 1/1991 | Pringle |
| 5,139,086 | A | 8/1992 | Griffith, Sr. |
| 5,222,559 | A | 6/1993 | Edwards et al. |

(Continued)

FOREIGN PATENT DOCUMENTS

| | | |
|---|---|---|
| GB | 725175 | 4/1955 |
| WO | 2009111887 | 9/2009 |

OTHER PUBLICATIONS

National Oilwell Varco Technical Summary "Agitator Tool", (2009), 2 pages.

(Continued)

*Primary Examiner* — Robert E Fuller
*Assistant Examiner* — David Carroll
(74) *Attorney, Agent, or Firm* — Conley Rose, P.C.

(57) ABSTRACT

A shock assembly for use with a motion tool deployable into a wellbore by a conveyance. The motion tool includes a mandrel operatively connectable to the conveyance or the motion tool, a housing operatively connectable to the motion tool or the conveyance (the housing having an opening to slidingly receive the mandrel and including a first and a second spring portion), a first spring slidably positionable in the first spring portion and having a first spring stiffness, and a second spring slidably positionable in the second spring portion having a second spring stiffness. The second spring stiffness being less than the first spring stiffness such that the first and second springs selectively engage as the housing slidingly moves about the mandrel in response to forces applied to the system to selectively restrict movement between the mandrel and the housing whereby the motion tool is vibrated.

21 Claims, 17 Drawing Sheets

(56) References Cited

U.S. PATENT DOCUMENTS

| | | | |
|---|---|---|---|
| 5,267,613 | A | 12/1993 | Zwart et al. |
| 5,678,633 | A | 10/1997 | Constantine, Jr. |
| 5,794,985 | A | 8/1998 | Mallis |
| 5,901,796 | A | 5/1999 | McDonald |
| 6,041,874 | A | 3/2000 | Lee |
| 6,138,772 | A | 10/2000 | Miescher et al. |
| 6,279,670 | B1 | 8/2001 | Eddison et al. |
| 6,431,294 | B1 | 8/2002 | Eddison et al. |
| 6,439,318 | B1 | 8/2002 | Eddison et al. |
| 6,467,547 | B2 | 10/2002 | Maguire et al. |
| 6,508,317 | B2 | 1/2003 | Eddison et al. |
| 6,634,424 | B2 | 10/2003 | Knowles |
| 6,634,428 | B2 | 10/2003 | Krauss et al. |
| 6,745,836 | B2 | 6/2004 | Taylor et al. |
| 6,761,231 | B1 | 7/2004 | Dock et al. |
| 6,820,697 | B1 | 11/2004 | Churchill |
| 6,923,255 | B2 | 8/2005 | Lee |
| 7,066,263 | B1 | 6/2006 | Mouton |
| 7,419,018 | B2 | 9/2008 | Hall et al. |
| 7,461,706 | B2 | 12/2008 | Eddison |
| 7,469,744 | B2 | 12/2008 | Ruddock et al. |
| 7,661,478 | B2 | 2/2010 | Palmer et al. |
| 7,673,708 | B2 | 3/2010 | Lee |
| 7,708,088 | B2 | 5/2010 | Allahar et al. |
| 7,857,058 | B2 | 12/2010 | Tulloch et al. |
| 7,900,716 | B2 | 3/2011 | Ibrahim et al. |
| 8,201,633 | B2 | 6/2012 | Hilliard |
| 8,215,418 | B2 | 7/2012 | Radford |
| 2001/0054515 | A1 | 12/2001 | Eddison et al. |
| 2004/0089461 | A1 | 5/2004 | Cioceanu |
| 2004/0140131 | A1* | 7/2004 | Susman ..... E21B 4/14 175/296 |
| 2005/0150693 | A1 | 7/2005 | Madden |
| 2005/0284665 | A1* | 12/2005 | Shears ..... E21B 31/107 175/57 |
| 2007/0181340 | A1 | 8/2007 | Eddison |
| 2008/0149340 | A1 | 6/2008 | Rose |
| 2008/0236841 | A1 | 10/2008 | Howlett et al. |
| 2010/0132954 | A1 | 6/2010 | Telfer |
| 2011/0031020 | A1 | 2/2011 | Cote |
| 2011/0132597 | A1 | 6/2011 | Hradecky |
| 2011/0132598 | A1 | 6/2011 | Hradecky |
| 2011/0198126 | A1 | 8/2011 | Swietlik et al. |
| 2012/0227973 | A1 | 9/2012 | Hart et al. |

OTHER PUBLICATIONS

Francis B., Staysko R., SPE/IADC 139926 "Fluid Hammer Drives Down Well Costs" (2011), 6 pages.

Scientific Drilling 4.75 Inch Downhole Vibrating (DHV) Tool (2010), 1 page.

Clayton, R., Hammer Tools and PDC Bits Provide Stick-Slip Solution, (Feb. 2010), 1 page.

United Diamond Ltd., The Crash Course Anatomy of the Stick-Slip Phenomenon, (2003), 2 pages.

WZL "Shock Tool" (Nov. 10, 2008), 2 pages.

Ulterra "Torkbuster" (date unknown but prior to the date of this application) 1 page.

Cougar Tool "Mech-Thruster" (date unknown but prior to the date of this application) 2 pages.

* cited by examiner

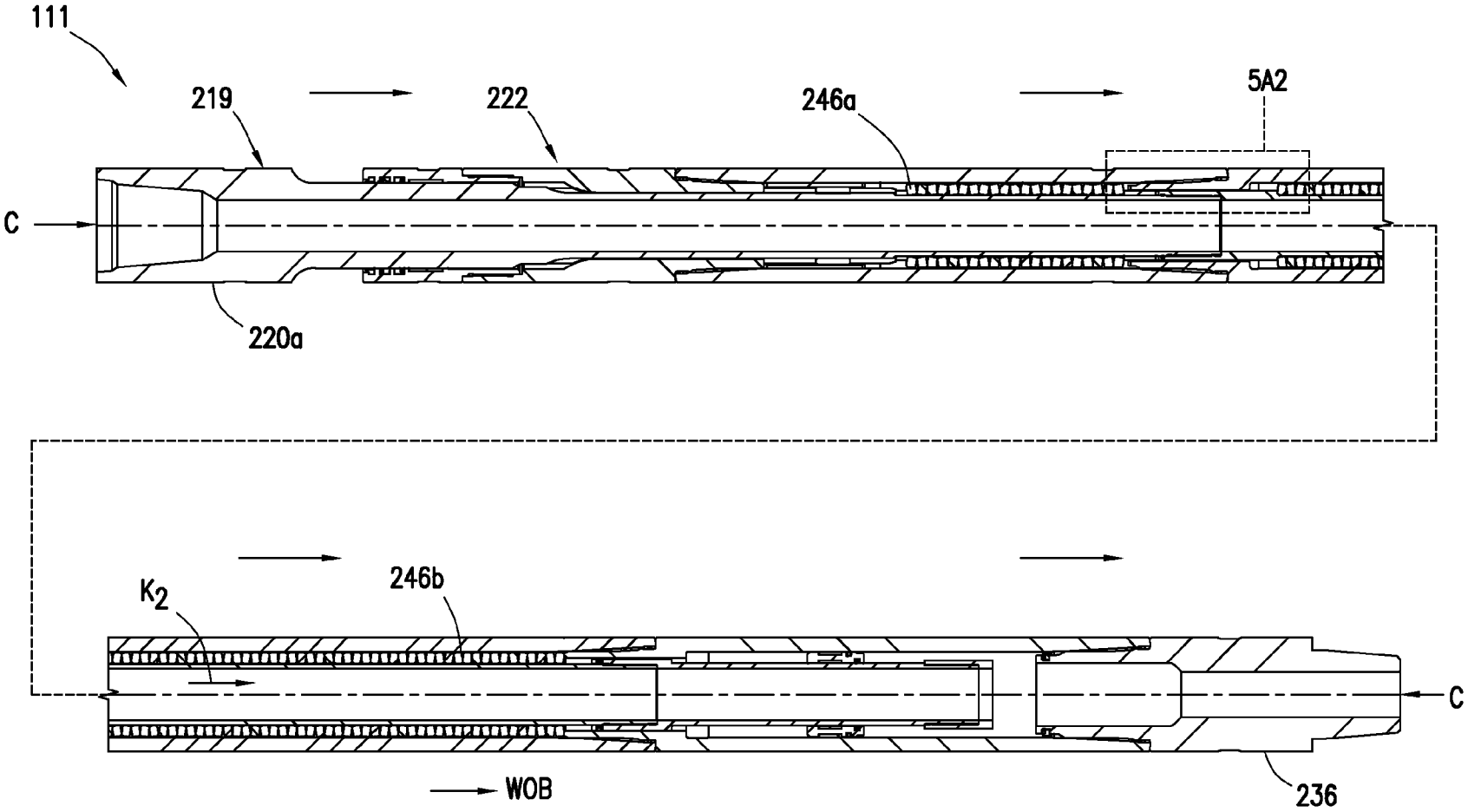
FIG.5A1

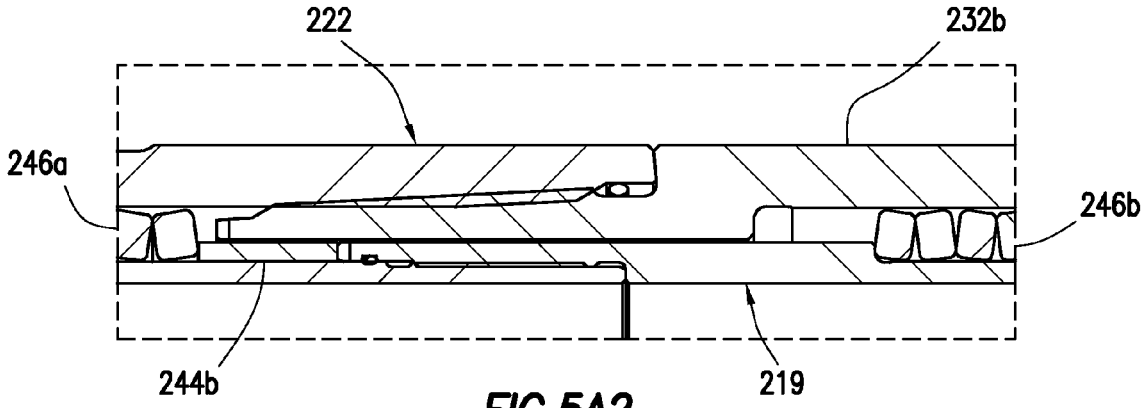
FIG.5A2
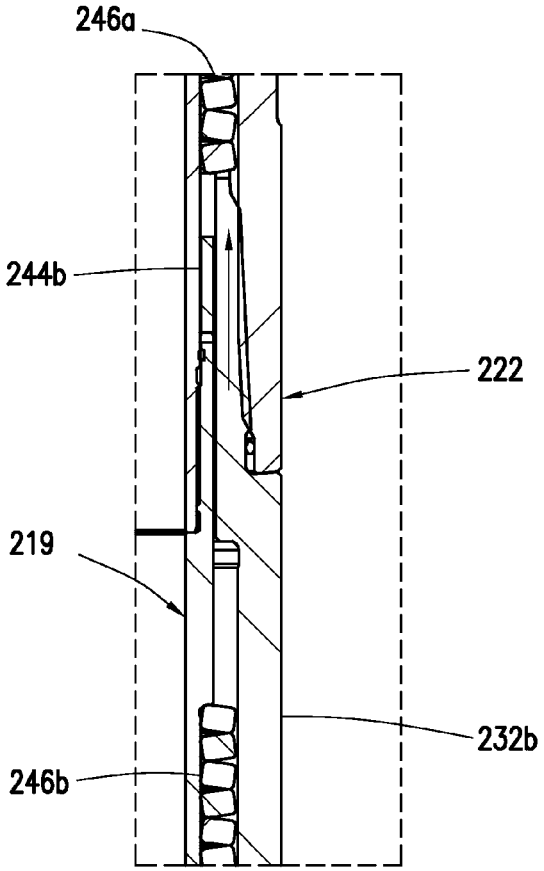
FIG.5B2

FIG.5B1
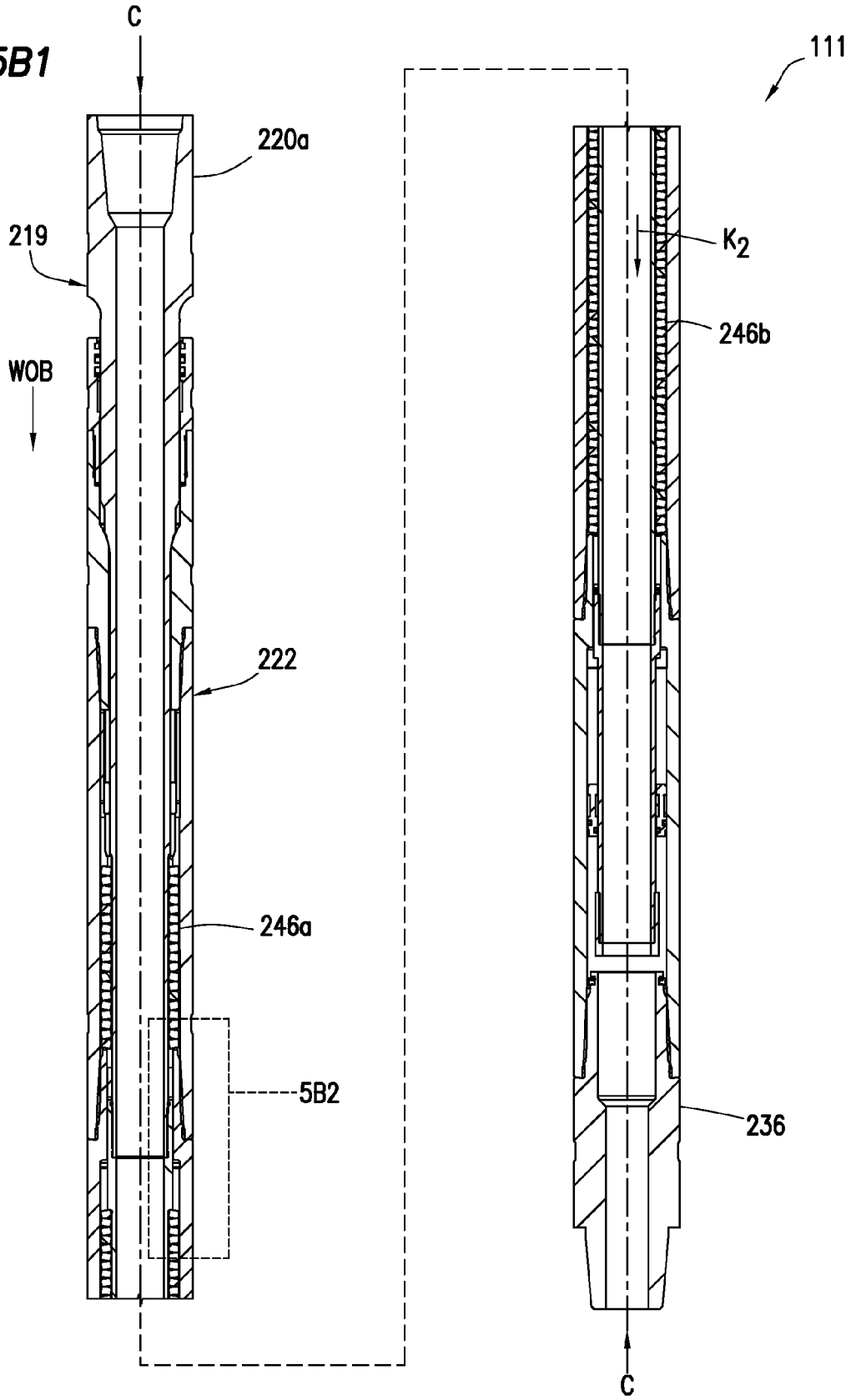

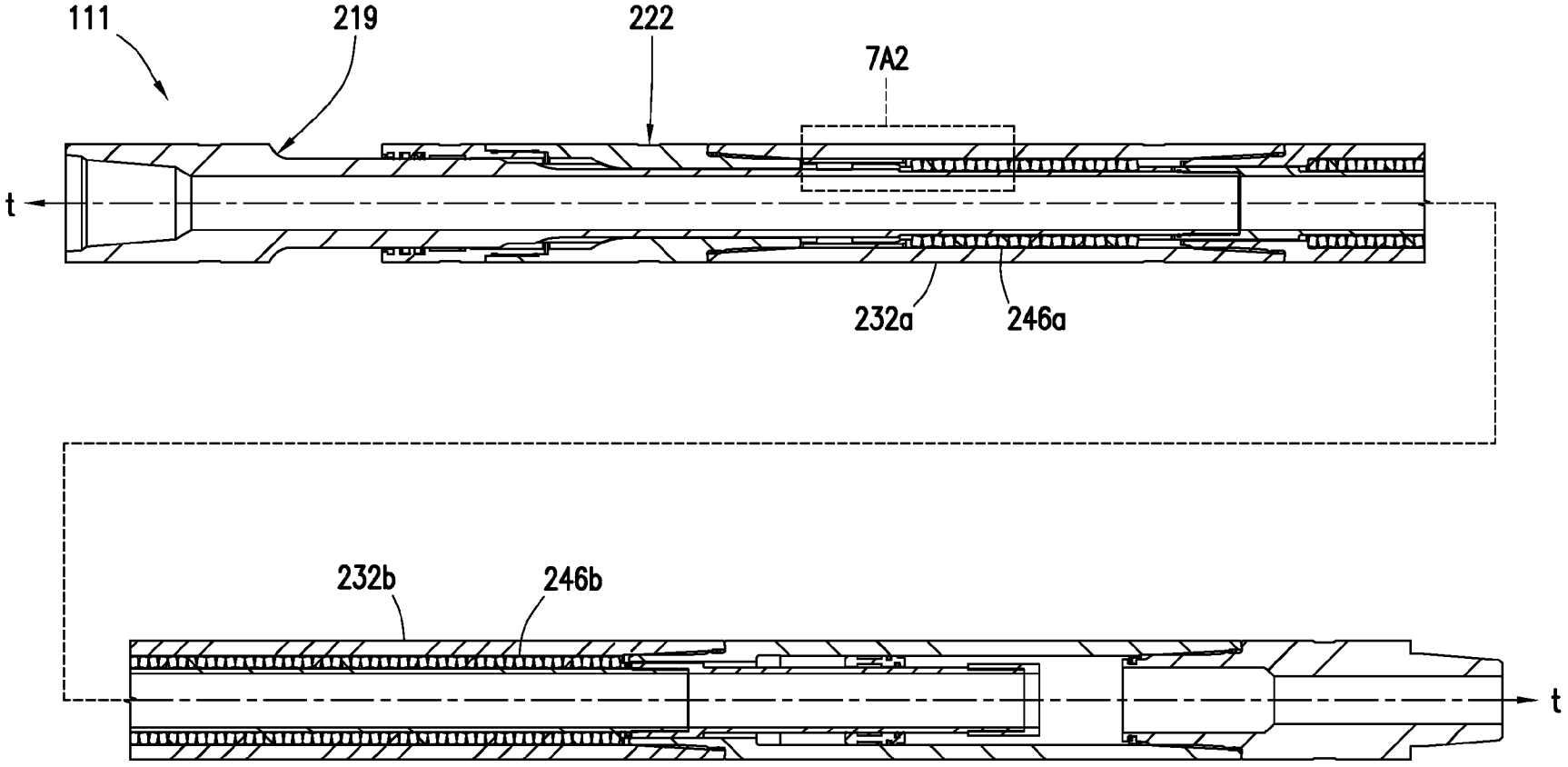
FIG. 7A1

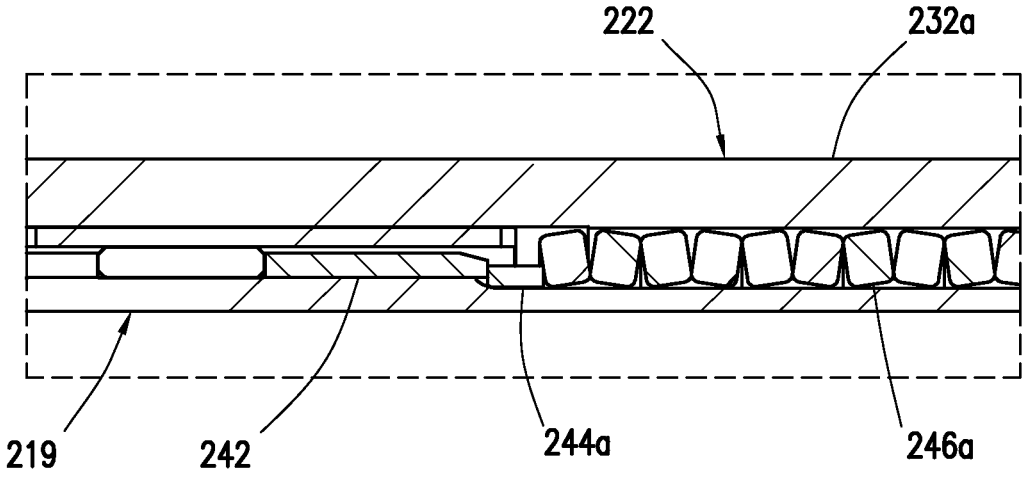
FIG. 7A2
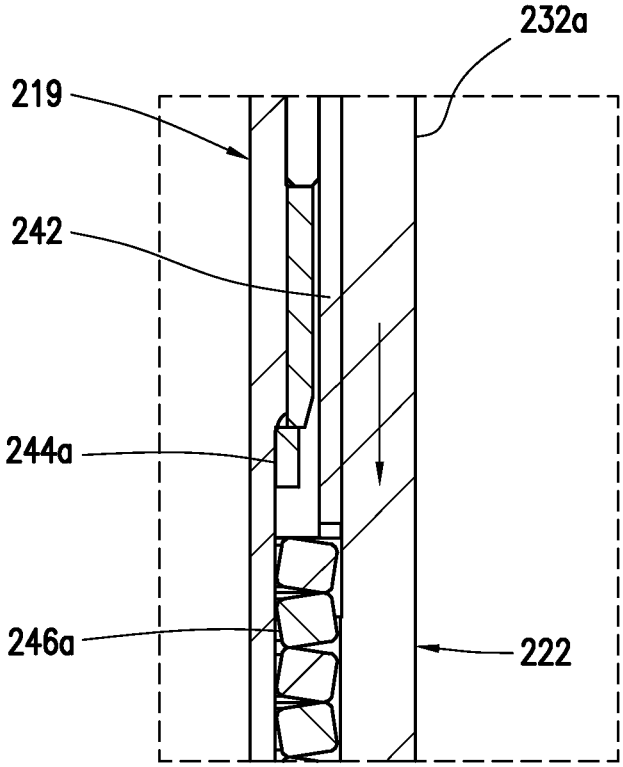
FIG. 7B2

FIG. 7B1
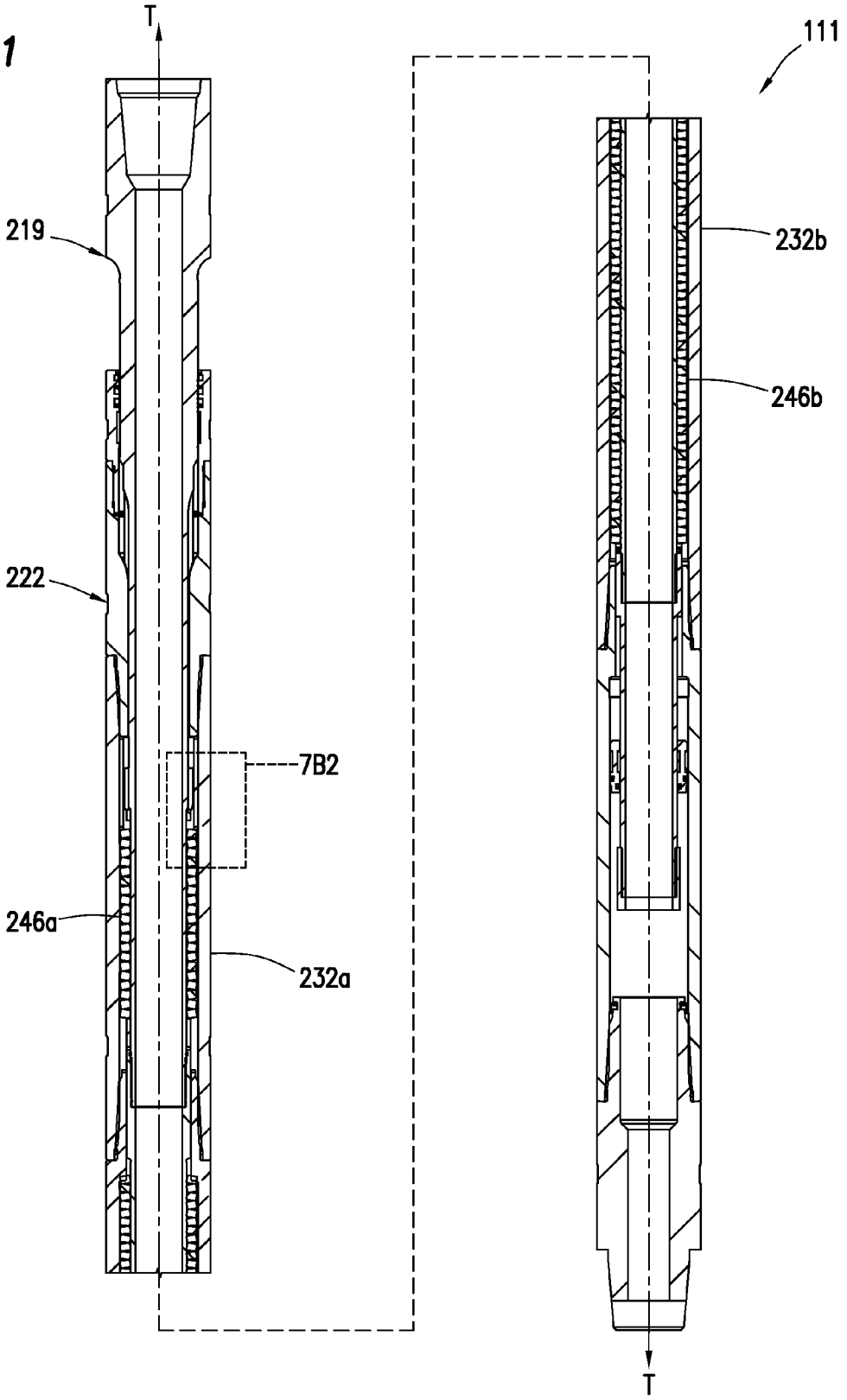

DOWNHOLE SHOCK ASSEMBLY AND METHOD OF USING SAME

BACKGROUND

This present disclosure relates generally to techniques for performing wellsite operations. More specifically, the present disclosure relates to downhole equipment, such as drilling, vibration, shock, agitating, and/or pulsing tools.

Oilfield operations may be performed to locate and gather valuable downhole fluids. Oil rigs are positioned at wellsites, and downhole equipment, such as a drilling tool, is deployed into the ground by a drill string to reach subsurface reservoirs. At the surface, an oil rig is provided to deploy stands of pipe into the wellbore to form the drill string. Various surface equipment, such as a top drive, a Kelly and a rotating table, may be used to apply torque to the stands of pipe and threadedly connect the stands of pipe together. A drill bit is mounted on the downhole end of the drill string, and advanced into the earth from the surface to form a wellbore.

The drill string may be provided with various downhole components, such as a bottom hole assembly (BHA), measurement while drilling, logging while drilling, telemetry and other downhole tools, to perform various downhole operations, such as providing power to the drill bit to drill the wellbore and performing downhole measurements.

During drilling or other downhole operations, the drill string and downhole components may encounter various downhole forces, such as downhole pressures (internal and/or external), torque on bit (TOB), weight on bit (WOB), etc. WOB refers to weight that is applied to the bit, for example, from the BHA and/or surface equipment. During drilling operations, portions of the drill string and/or BHA may be subject to tension and/or to compression.

Various downhole devices, such as drilling tools, agitating tools, pulsing tools, drilling motors and other devices, have been provided to facilitate drilling of wellbores. Examples of downhole devices are provided in U.S. Pat. Nos. 4,428,443 and 7,419,018.

SUMMARY

In at least one aspect, the disclosure relates to a shock assembly for use in conjunction with a motion tool deployable into a wellbore penetrating a subterranean formation by a conveyance. The shock assembly includes a mandrel operatively connectable to one of the conveyance and the motion tool, a housing operatively connectable to another of the conveyance and the motion tool (the housing having an opening to slidingly receive the mandrel), and a first spring and a second spring slidably positionable in the housing between the mandrel and the housing. The first spring has a first spring stiffness and the second spring has a second spring stiffness. The second spring stiffness is less than the first spring stiffness such that the first and second springs selectively engage as the housing slidingly moves about the mandrel in response to forces applied to the system to selectively restrict movement between the mandrel and the housing whereby the motion tool is vibrated.

The second spring may be engaged when the forces are applied to the conveyance. The first spring may be engageable when the forces are sufficient to move the housing to a pre-determined position along the mandrel. The shock assembly may also include a compression spacer in the housing between the first spring and the mandrel. The second spring is engageable when the second spring portion of the housing remains a distance from a first end of the compression spacer, and the first and second springs are engageable when the second spring portion advances along the mandrel past the compression spacer. The shock assembly may also include a tension spacer and an extension sleeve in the housing between a splined portion of the housing and the first spring. The second spring is engageable when the second spring portion of the housing remains a distance from a second end of the tension spacer. The first and second springs are engageable when the extension sleeve is moved past the tension spacer when the second spring portion of the housing advances along the mandrel toward a second end of the mandrel.

The housing and the mandrel may include a splined portion. The splined portion of the mandrel is receivingly engageable with the splined portion of the housing. The shock assembly may also include a lock ring positionable between the housing and the mandrel, the lock ring defining a stop for travel of the splined portion along the mandrel. The housing may include an end cap, a splined portion, a first spring housing, a second spring housing, a balancing sub, and a bottom sub. The mandrel may include a first portion, a second portion, and a washpipe. A second end of the mandrel may be engageable with a balancing sub of the housing to limit travel therebetween. A first portion of the mandrel has a shoulder engageable with a first end of the housing to limit travel therebetween. The conveyance may be a drill string and the motion tool may be a pulsing tool or a vibrating tool. The mandrel may be operatively connectable to the drill string and the housing operatively connectable to the motion tool. The mandrel is operatively connectable to the motion tool and the housing is operatively connectable to the conveyance.

In another aspect, the disclosure relates to a system for use in a wellbore penetrating a subterranean formation. The drilling system includes a conveyance deployable into the wellbore, at least one motion tool operatively connectable to the conveyance, and at least one shock assembly operatively connectable between the conveyance and the motion tool. The shock assembly includes a mandrel operatively connectable to one of the conveyance and the motion tool, a housing operatively connectable to another of the conveyance and the motion tool (the housing having an opening to slidingly receive the mandrel), and a first spring and a second spring slidably positionable in the housing between the mandrel and the housing. The first spring has a first spring stiffness and the second spring has a second spring stiffness. The second spring stiffness is less than the first spring stiffness such that the first and second springs selectively engage as the housing slidingly moves about the mandrel in response to forces applied to the system to selectively restrict movement between the mandrel and the housing whereby the motion tool is vibrated.

Finally, in another aspect, the disclosure relates to a method of vibrating a motion tool deployable into a wellbore penetrating a subterranean formation by a conveyance. The method involves operatively connecting at least one shock assembly between the conveyance and the motion tool. The shock assembly includes a mandrel, a housing having an opening to slidingly receive the mandrel, a first and a second spring slidably positionable in the housing between the mandrel and the housing. The second spring has a stiffness less than a stiffness of the first spring. The method further involves vibrating the downhole tool by selectively engaging the first and second springs as the housing slidingly moves about the mandrel in response to forces applied to the conveyance.

The downhole tool may be a drilling tool comprising a drill string with a bit at a downhole end thereof and the method may involve advancing the drill bit into the subterranean formation to form the wellbore. The vibrating may involve engaging the second spring and the first spring when the forces are above a pre-determined minimum, engaging the second spring but not the first spring when the forces are below a pre-determined maximum, and/or engaging the second spring when the forces are applied to the drill string.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. It is to be noted, however, that the appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

FIG. 5A1 depicts a cross-sectional view of the drilling tool of FIG. 2A subject to the forces of FIG. 4A. FIG. 5A2 depicts a detailed view of a portion of the drilling tool of FIG. 5A1.

FIG. 5B1 depicts a cross-sectional view of the drilling tool of FIG. 2A subject to the forces of FIG. 4B. FIG. 5B2 depicts a detailed view of a portion of the drilling tool of FIG. 5B1.

FIG. 7A1 depicts a cross-sectional view of the drilling tool of FIG. 2A subject to the forces of FIG. 6A. FIG. 7A2 depicts a detailed view of a portion of the drilling tool of FIG. 7A1.

FIG. 7B1 depicts a cross-sectional view of the drilling tool of FIG. 2A subject to the forces of FIG. 6B. FIG. 7B2 depicts a detailed view of a portion of the drilling tool of FIG. 7B1.

DETAILED DESCRIPTION

The description that follows includes exemplary apparatuses, methods, techniques, and/or instruction sequences that embody techniques of the present subject matter. However, it is understood that the described embodiments may be practiced without these specific details.

The present disclosure relates to a shock assembly connectable to a conveyance for absorbing shock of downhole tools, such as downhole pulsing, agitating, or other motion tools. The shock assembly includes a mandrel slidably positionable within a housing to absorb shock, to create vibration and/or to reduce friction between the drill string and the wellbore. The mandrel and the housing are connected between a conveyance (e.g., drill string or other tubing) and a motion tool (e.g., pulser or agitator). First and second springs having different stiffnesses (or spring ratings) are positioned in the housing to absorb shock applied to the drill string. The first spring may have greater stiffness than the second spring to selectively engage and absorb shock depending on the forces (e.g., tensile, compressive, WOB, etc.) applied to the shock assembly.

Figure 1:
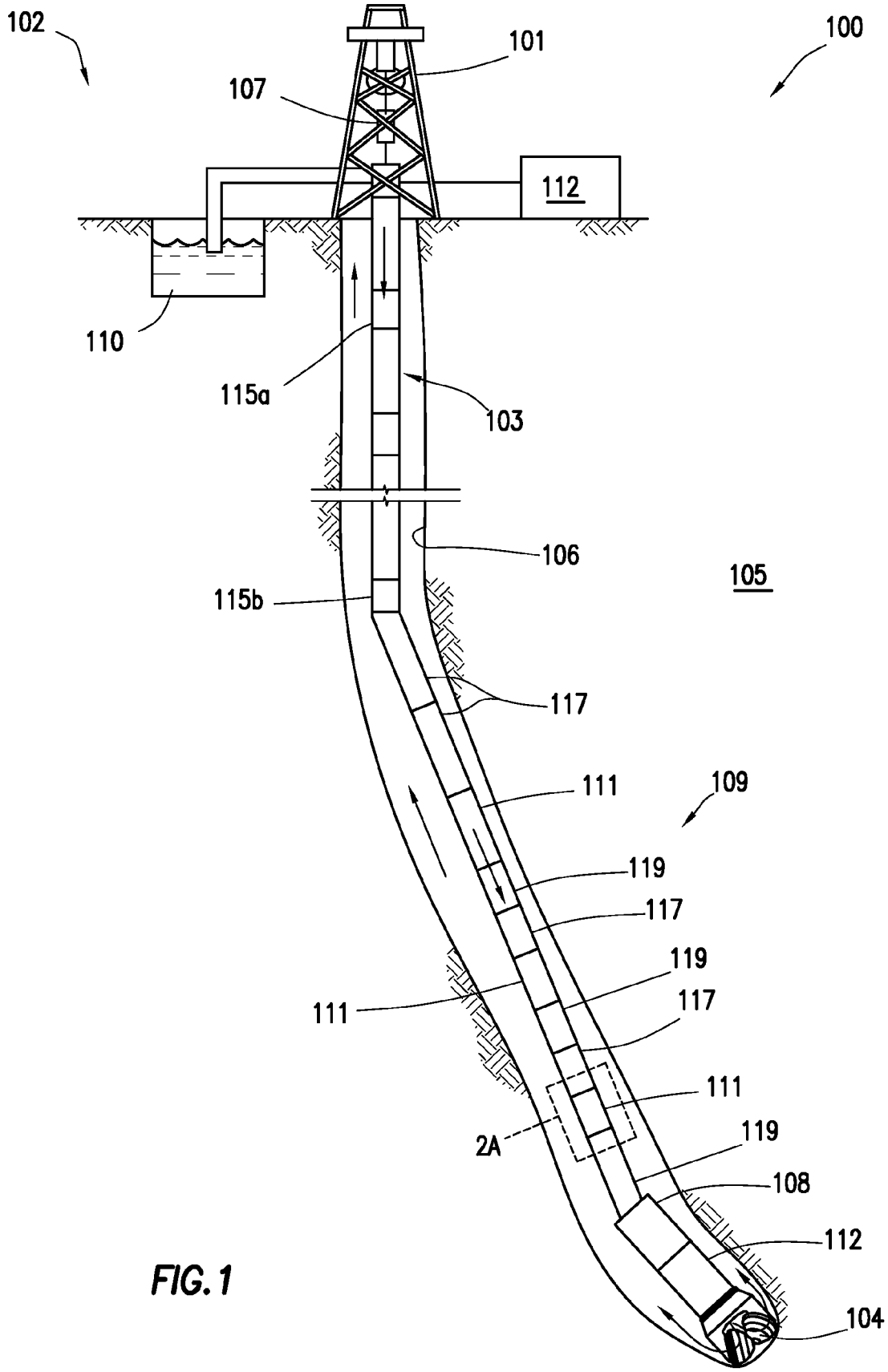
FIG. 1 depicts a schematic view, partially in cross-section, of a wellsite having a surface system and a downhole system for drilling a wellbore.

FIG. 1 depicts an example environment in which a drilling assembly may be used. FIG. 1 depicts a drilling system 100 that includes a rig 101 positionable at a wellsite 102 for performing various wellbore operations, such as drilling. While a land-based drilling rig with a specific configuration is depicted, the drilling assembly herein may be usable with a variety of land or offshore applications. Also, while the rig 101 is depicted as an oil rig for deploying a drilling tool downhole, the rig 101 may be any device capable of deploying a downhole tool into a wellbore by a conveyance.

The drilling system 100 also includes a downhole drilling tool including a drill string (or conveyance) 103 with a bottom hole assembly (BHA) 108 and the drill bit 104 at an end thereof deployed from the rig 101. The drill string 103 may include drill pipe, drill collars, or other tubing used in drilling operations. The drill string may include combinations of standard drill pipe 115*a*, heavy weight drill pipe 115*b* and/or drill collars 117. The drill bit 104 is advanced into a subterranean formation 105 to form a wellbore 106. Various rig equipment 107, such as a Kelly, rotary table, top drive, elevator, etc., may be provided at the rig 101 to support and/or drive the drill string 103.

The bottom hole assembly (BHA) 108 is at a downhole end of the drill string 103 and contains various equipment for performing downhole operations. Such equipment may include, for example, measurement while drilling, logging while drilling, telemetry, processors and/or other downhole tools. A driver, such as a downhole motor, 109 is also provided uphole of the bit 104 for rotationally driving the bit 104. While a drilling system 100 with a drill string 103, BHA 109, and a bit 104 is depicted, other downhole tools may be employed.

A mud pit 110 may be provided at the surface for passing mud through the drill string 103, the BHA 109 and out the bit 104 as indicated by the arrows. A surface controller 112 is also provided at the surface to operate the drilling system. As shown, the BHA 109 includes a downhole controller 112 for communication between the BHA 109 and the surface controller 112. One or more controllers 112 may be provided.

Along the drill string 103, various drilling tools, such as shock assemblies 111 and motion tools (e.g., agitators or pulsers) 119 may also be provided. Drill collars 117 (or spacers) may optionally be provided between the various shock assemblies 111 and motion tools 119. The shock assemblies 111 may be connected to the motion tools 119 uphole therefrom. The motion tool 119 located at a downhole end of the drill string 103 may be coupled to the drilling motor 108 for operation therewith. While three sets of shock assemblies 111 and motion tools 119 are depicted, one or more may be provided.

Figure 2A:
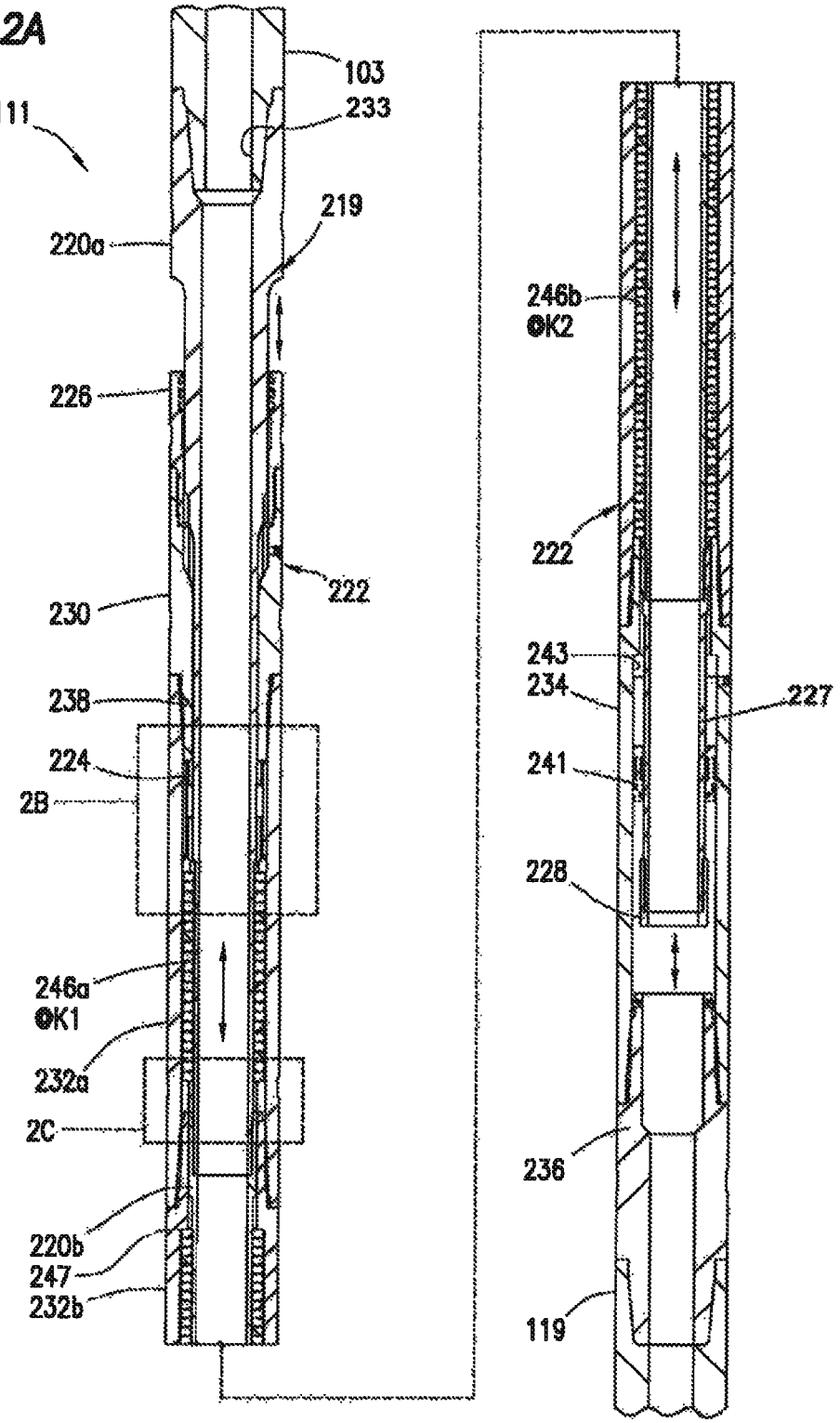
FIG. 2A depicts a cross-sectional view of a portion of a drilling tool having a shock assembly.
Figure 2C:
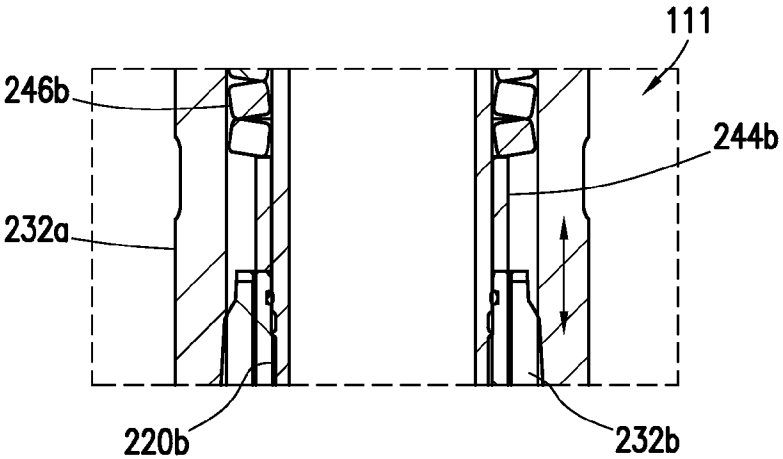
FIGS. 2B and 2C are detailed views of portions of the drilling tool of FIG. 2A.
Figure 2B:
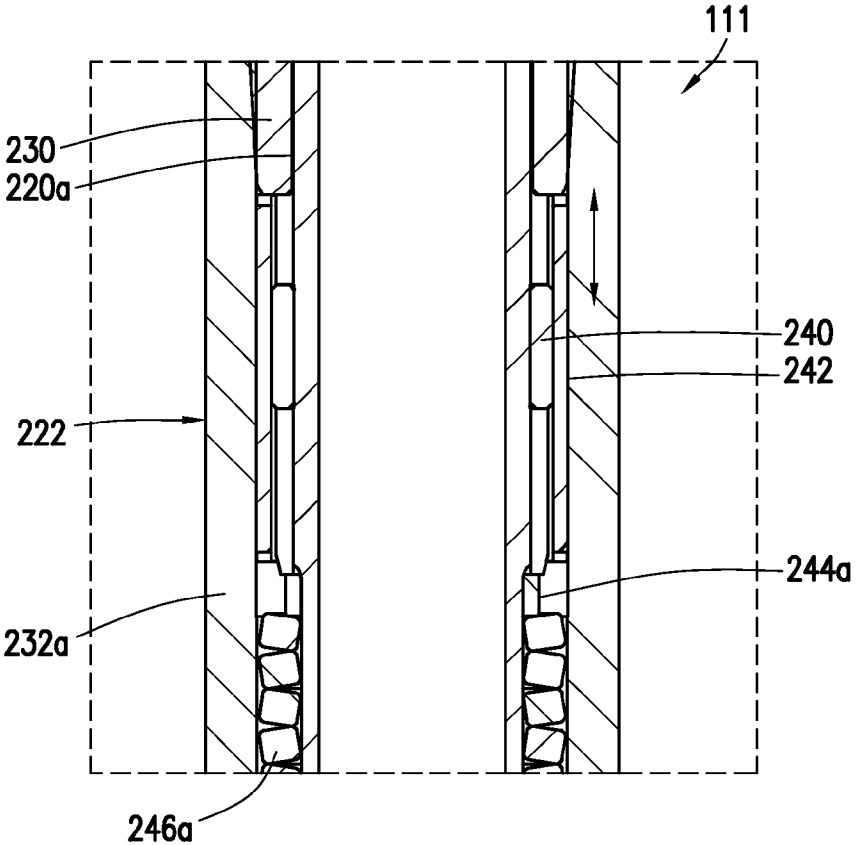
Figure 3A:
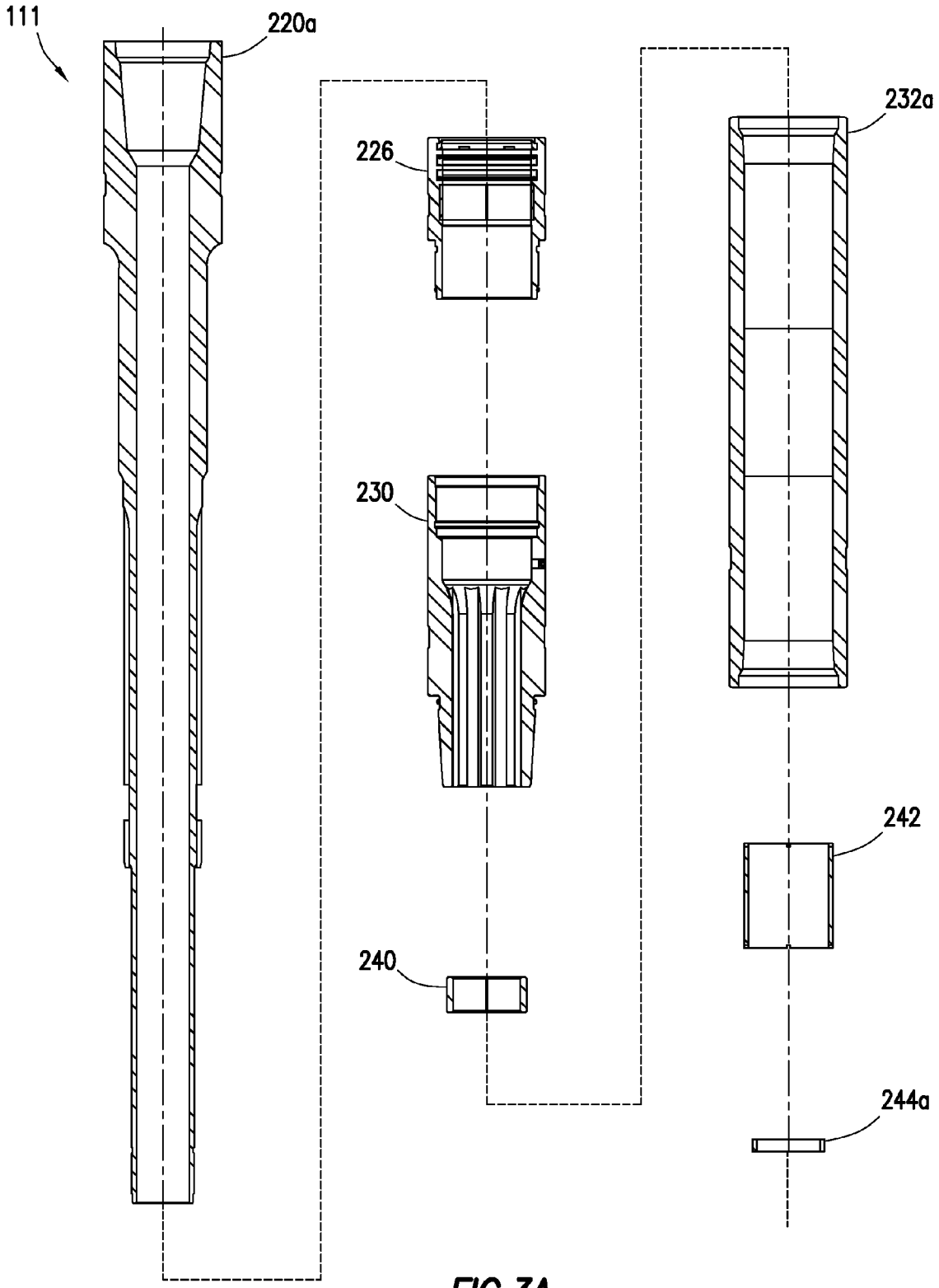
FIGS. 3A-3C depict an exploded view of the drilling tool of FIG. 2.
Figure 3B:
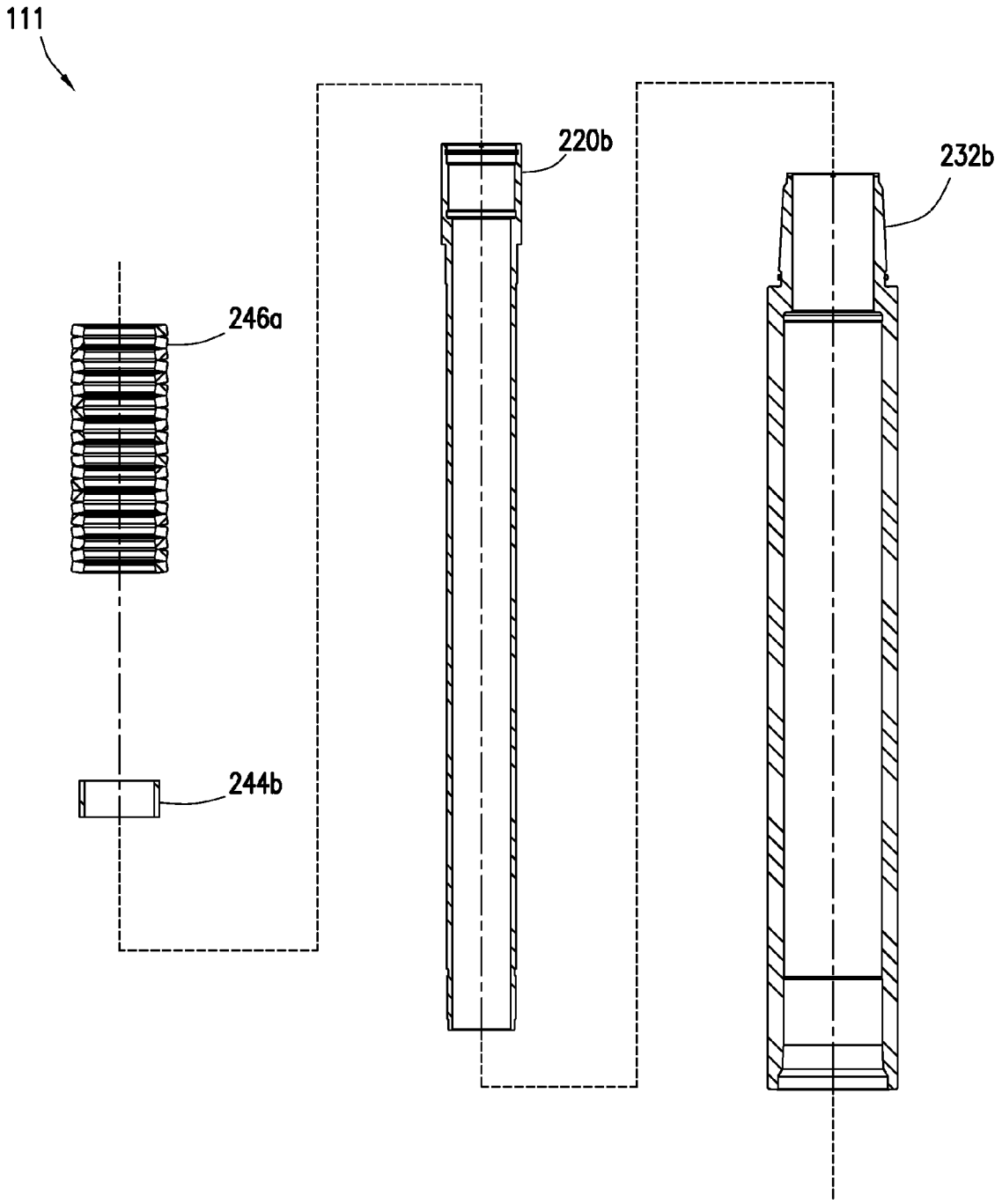
Figure 3C:
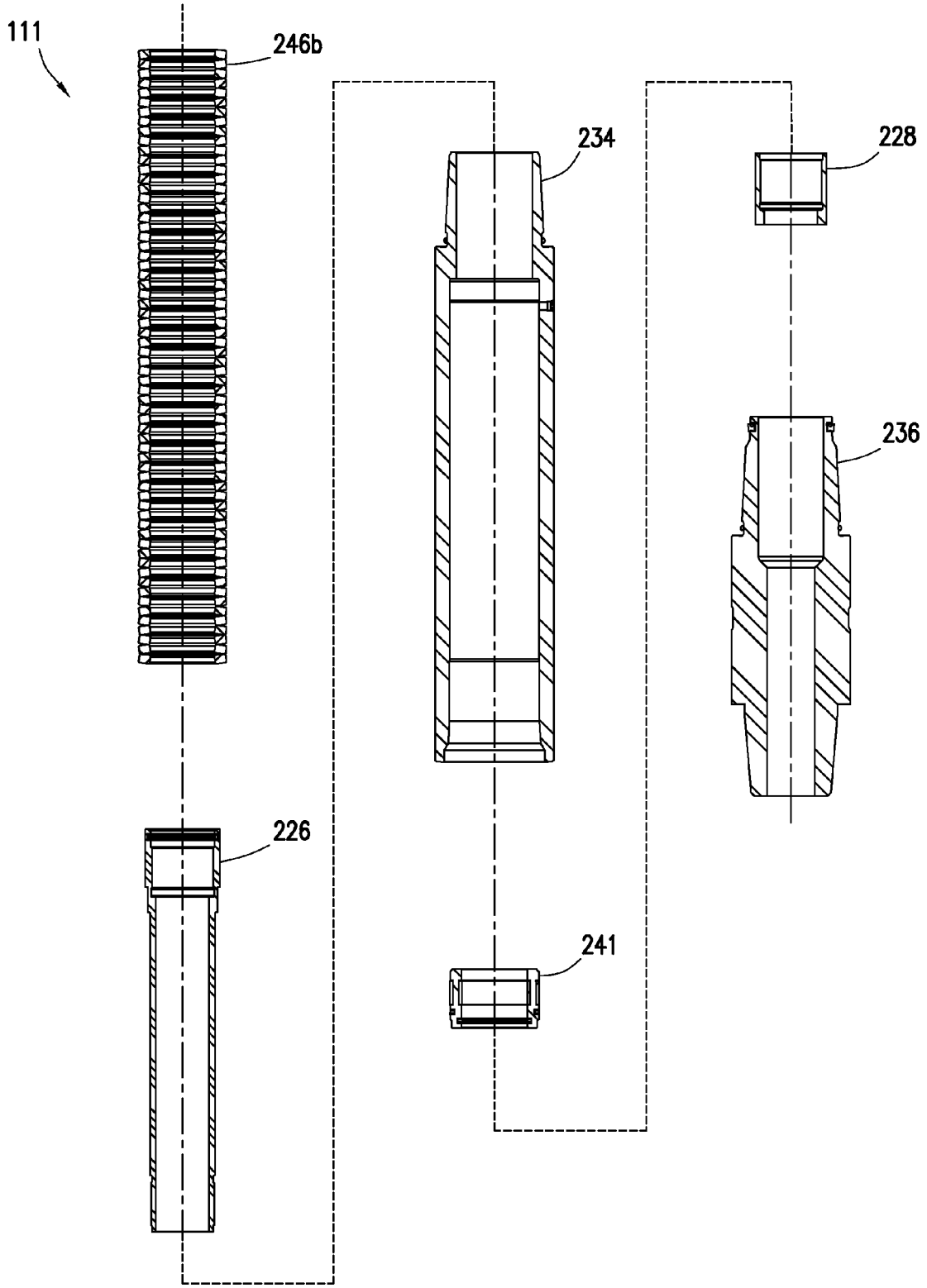

FIGS. 2A-2C and 3A-3C depict various views of a shock assembly 111. FIG. 2A is a cross-sectional view of a portion 2A of the drill string 103 including the shock assembly 111 of FIG. 1. FIGS. 2B and 2C are detailed views of portions 2B and 2C, respectively, of the shock assembly 111. FIGS. 3A-3C are an exploded view of the shock assembly 111.

The shock assembly 111 includes a mandrel 219 slidably positionable within a housing 222. The mandrel 219 and the housing 222 each have a first end and a second end. As shown in the drawings, the first end is adjacent the drill string 103 and the second end is adjacent the motion tool 119. However, it will be appreciated that the shock assembly 111 may be placed in an inverted position with the first end adjacent the motion tool 119 and the second end adjacent the conveyance 103.

In an upright position as shown and described in the figures herein, the shock assembly 111 is depicted with the first end of the mandrel 219 at the uphole end and the second end of the housing 222 may be the downhole end. The shock assembly 111 may be moved to an inverted position such that the first end of the mandrel 219 may be the downhole end and the second end of the housing may be the uphole end. Thus, the shock assembly 111 may be reversible in either orientation for shock absorption between the conveyance 103 and motion tool 119. For descriptive purposes, aspects of the shock assembly 111 as described herein will refer to the first end as the uphole end and the second end as the downhole end.

Referring still to FIGS. 2A-3C, a passage 233 extends through the shock assembly 111 to permit the passage of drilling mud therethrough. The mandrel 219 includes an uphole (or first) portion 220*a* and a downhole (or second) portion 220*b* disposable into the housing 222. The uphole portion 220*a* is operatively connectable at an uphole (or first) end to the drill string 103. The uphole portion 220*a* has mandrel splines 224 at a downhole end thereof. A downhole (or second) end of the uphole portion 220*a* is operatively connectable to an uphole end of the downhole portion 220*b*. A washpipe 227 is connected to a downhole (or second) end of the downhole portion 220*b*. A stop nut 228 is at a downhole end of the washpipe 227.

The housing 222 includes a splined portion 230, an uphole (or first) spring portion 232*a*, a downhole (or second) spring portion 232*b*, a balancing sub 234 and a bottom sub 236. An uphole end of the housing 222 has an opening to slidingly receive the uphole and downhole portions 220*a,b* of mandrel 219. A downhole (second) end of the housing 222 is operatively connectable to the motion tool 119.

The housing 222 has an inner diameter to receive the uphole and downhole portions 220*a,b*. An end cap 226 is positioned at an uphole end of the housing 222 and the bottom sub 236 is at a downhole end of the housing 222. The end cap 226 may retain fluid, such as oil, inside the housing 222. Seals may be provided about the end cap 226.

The splined portion 230 is operatively connected between the end cap 226 and the uphole spring portion 232*a*. The splined portion 230 has housing splines 238 on an inner surface thereof to engagingly receive the mandrel splines 224 of the uphole portion 220*a* and prevent rotation therebetween. In compression, the movement of the housing 222 relative to the mandrel 219 is stopped where the mandrel splines 224 engage a terminal end of the housing splines 238. An uphole (or first) end of the downhole spring portion 232*b* is operatively connected to a downhole (or second) end of the uphole spring portion 232*a*. The balancing sub 234 is operatively connected between the downhole spring portion 232*b* and the bottom sub 236. A downhole (or second) end of the bottom sub 236 is connectable to the motion tool 119.

An uphole (or first or hard) spring 246*a* is positioned in the uphole spring portion 232*a* between the housing 222 and the mandrel 219. The uphole spring 246*a* is also positioned between the splined portion 230 and the downhole portion 220*b*.

A downhole (or second or soft) spring 246*b* is positioned in the downhole spring portion 232*b* between the housing 222 and the mandrel 219. The downhole spring 246*b* is also positioned between a spring shoulder 247 of the downhole spring portion 232*b* and an uphole end of the balancing sub 234. The uphole and downhole springs 246*a,b* have a stiffness (or spring rate) K1, K2, respectively. The spring rate K1 of the uphole spring 246*a* is greater than the spring rate K2 of the downhole spring 246*b*.

A piston 241 is positioned in the balancing sub 234 about the washpipe 227. The piston 241 is positioned between the balancing sub 234 and the wash pipe 227 for isolating hydraulic fluid in a cavity 243. The cavity 243 extends between the housing 222 and the uphole and downhole portions 220*a,b* of mandrel 219 for providing hydraulic fluid (e.g., oil) to lubricate the shock assembly 111. The piston 241 selectively extends and retracts to maintain the hydraulic fluid under pressure in the cavity 243 and to isolate the hydraulic fluid from the passage 233 and downhole fluids passing therethrough.

As shown in FIGS. 2A and 2B, an extension sleeve 242 and an uphole (or tension) spacer 244*a* are positioned between the splined portion 230 of the housing 222 and the uphole spring 246*a*. The extension sleeve 242 is positioned between the uphole spacer 244*a* and the splined portion 230 and between the lock ring 240 and the uphole spring portion 232*a*. The uphole spacer 244*a* is positioned between the uphole spring 246*a* and the extension sleeve 242 and between the uphole portion 220*a* and the uphole spring 246*a*. The housing 222 is slidably movable about the mandrel 219 such that the extension sleeve 242 is positionable relative to the downhole spacer 244*b* as the housing 222 slidingly moves along the mandrel 219.

A lock ring 240 is positioned in the housing 222 at an uphole (or first) end of the uphole spring portion 232*a* to act as a stop to prevent movement of the splined portion 230 beyond the lock ring 240. When under tension, movement of the uphole spring portion 232*a* relative to the mandrel stops when the splines 238 engage the lock ring 240. Movement of the housing 222 is thereby restricted by the travel permitted for movement of the splined portion 230 between the lock ring 240 and a terminal end of the splines 238 of the splined portion 230.

As shown in FIGS. 2A and 2C, a downhole (or compression) spacer 244*b* is positioned in the uphole spring portion 232*a* between the uphole spring 246*a* and the downhole spring portion 232*b*. The downhole spacer 244*b* is also positioned between the downhole portion 220*b* and the uphole spring portion 232*a*. The housing 222 is slidably movable about the mandrel 219 such that the downhole spring portion 232*b* is positionable relative to the uphole spacer 244*a* as the housing 222 slidingly moves along the mandrel 219.

Referring to FIGS. 2A-2C, the downhole spring 246*b* is engaged when forces (e.g., WOB, TOB, compression, tension, etc.) are applied to the drill string 103. The uphole spring 246*a* is engageable when the forces are sufficient to move the housing 222 to a pre-determined position along the mandrel 219. The downhole spring 246*b* is engageable when a downhole spring portion 232*b* of the housing 222 remains a distance from an uphole (or first) end of the downhole spacer 244*b*. The uphole and downhole springs 246*a,b* are engageable when the downhole spring portion 232*b* advances uphole along the mandrel 219 past the downhole spacer 244*b* and toward the first end of mandrel 219.

The downhole spring 246*b* is engageable when a downhole spring portion 232*b* of the housing 222 remains a distance from a downhole (or second) end of the tension spacer 244*a*. The uphole and downhole springs 246*a,b* are engageable when the extension sleeve 242 is moved past the tension spacer 244*a* when a downhole spring portion 232*b* of the housing 222 advances downhole along the mandrel 219 toward the second end of mandrel 219.

The engagement of the springs 246*a,b* in response to forces applied to the drill string 103 may be used to generate vibration. Pressure of fluid passing through passage 233 may also be used to generate vibration. When pressure in the passage 233 is greater than pressure in the wellbore 106 and outside the shock assembly 111, the differential pressure created across the shock assembly 111 may be used to move the housing 222 to an extended position relative to the mandrel 219. Pressure pulses generated through the drill string 103 and into the passage 233 may be used to move the housing 222 about the mandrel 219 to create vibration.

Figure 4A:
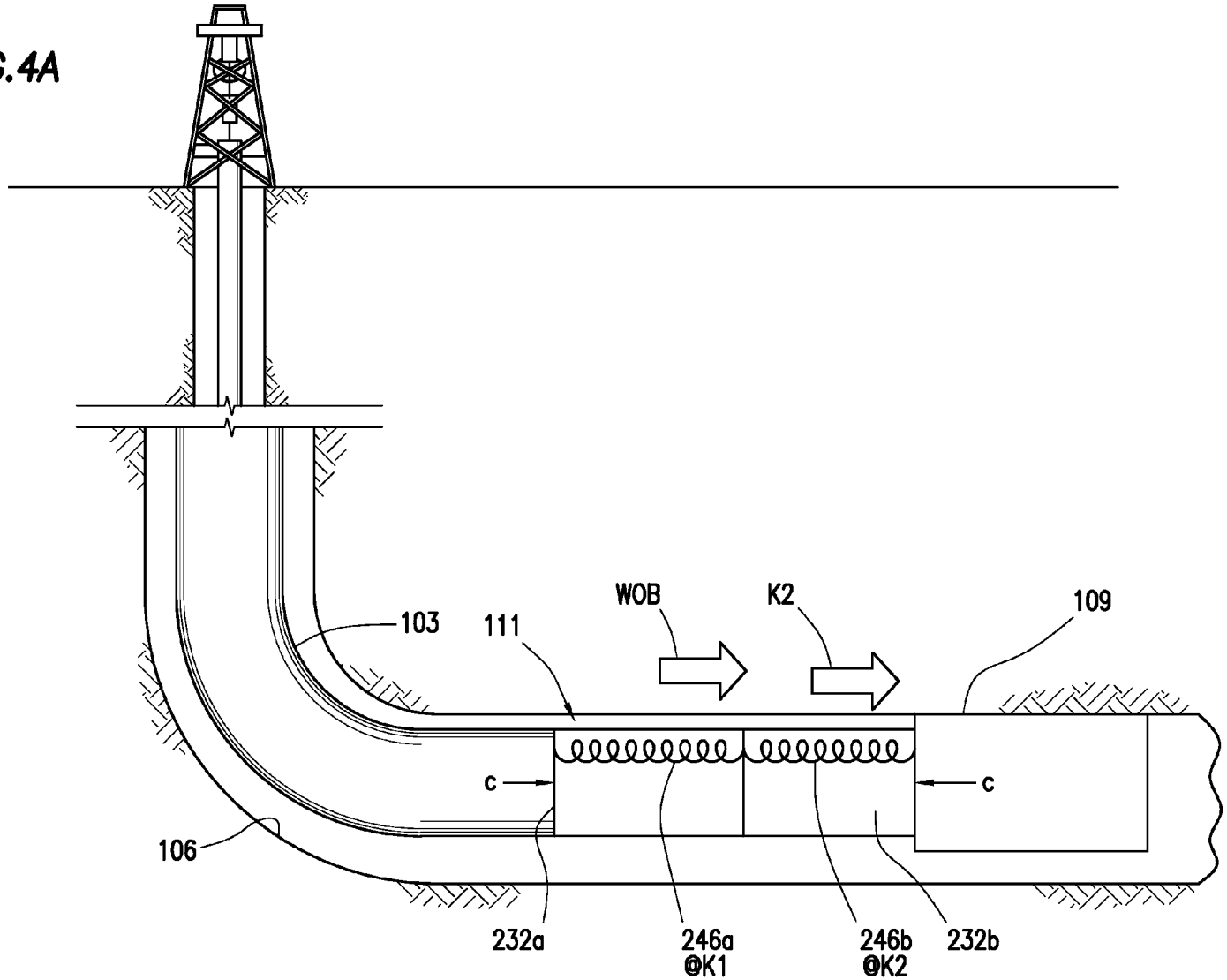
FIGS. 4A and 4B are schematic diagrams depicting forces applied to a drilling tool under compression in horizontal and vertical portions, respectively, of the wellbore.
Figure 4B:
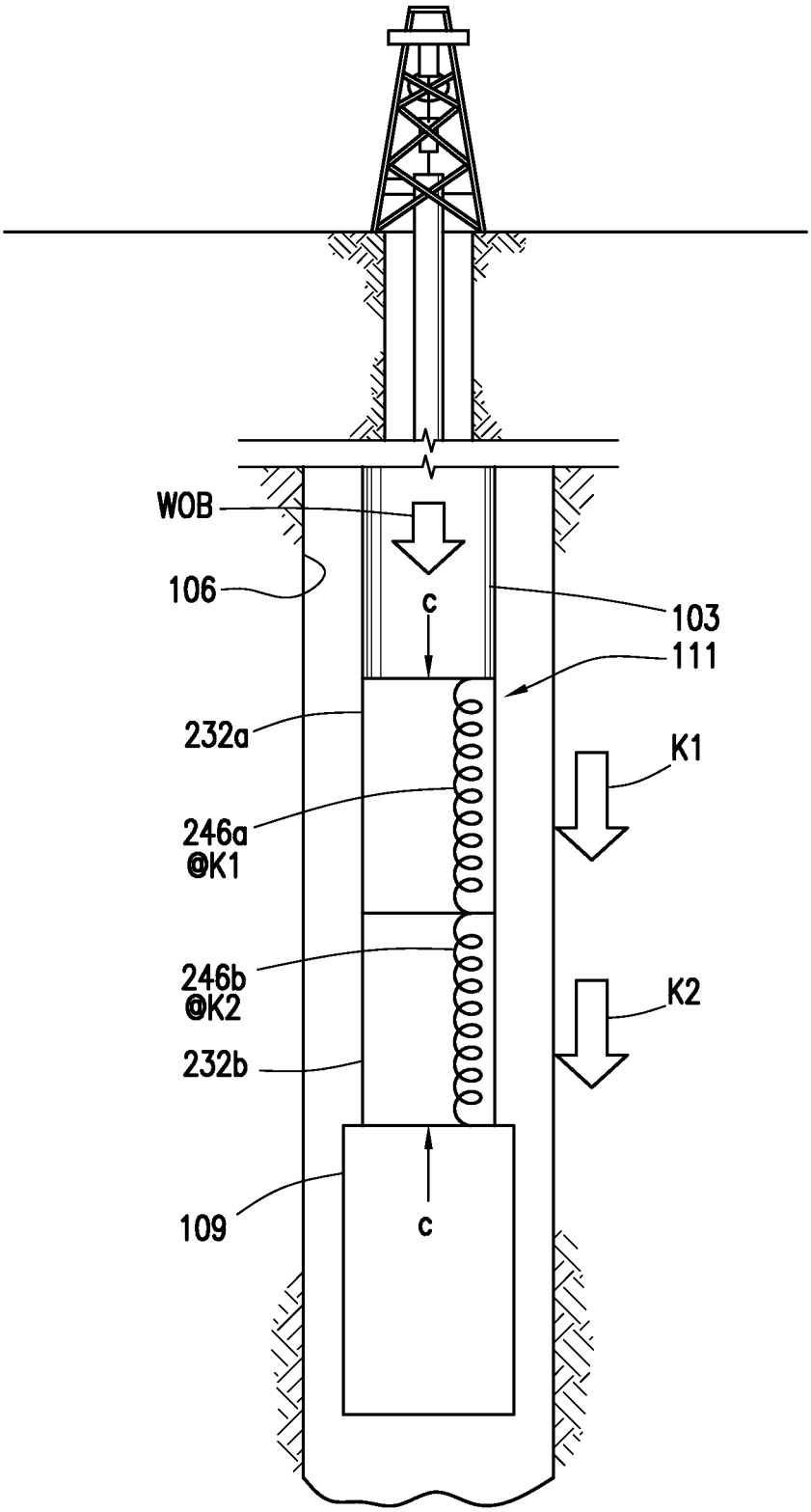

FIGS. 4A-5B2 depict operation of the shock assembly 111 under compression. FIGS. 4A and 4B are schematic diagrams depicting forces on the drill string 103 and on the shock assembly 111 when positioned adjacent the BHA 109 and subject to compressive forces c, C as weight on bit (WOB) is applied thereto. FIG. 4A shows the shock assembly 111 in a horizontal portion of the wellbore 106. FIG. 4B shows the shock assembly 111 in a vertical portion of the wellbore 106.

FIGS. 4A and 4B show the shock assembly 111 as having the uphole and downhole springs 246*a,b* with spring stiffnesses K1, K2. As shown in FIG. 4A, when the shock assembly 111 is subject to WOB in a horizontal portion of the wellbore 106, a smaller WOB force with light compression c is applied thereto. In such cases, the downhole spring 246*b* is partially compressed and the stiffness K2 of the downhole spring 246*b* is engaged as indicated by the arrow K2. As shown in FIG. 4B, when the shock assembly 111 is subject to WOB in a vertical portion of the wellbore 106, a greater WOB force with heavy compression C is applied thereto. In such cases, the downhole spring 246*b* is heavily compressed and the spring stiffnesses K1 and K2 of the uphole spring 246*a* and the downhole spring 246*b* are both engaged.

FIGS. 5A1 and 5A2 depict operation of the shock assembly 111 as the drill string 103 (FIG. 1) is subjected to the forces depicted in FIG. 4A. FIG. 5A1 shows a cross-sectional view of the shock assembly 111. FIG. 5A2 shows a portion 5A2 of the shock assembly 111 of FIG. 5A1 in greater detail.

As shown in these figures, the downhole spring portion 232*b* moves a distance relative to downhole spacer 244*b* as the housing 222 moves along mandrel 219 toward the first end of the mandrel 219 in response to the forces. In this position, the shock assembly 111 is in light compression, the downhole (softer) spring 246*b* is partially compressed, and a downhole spacer 244*b* prevents the uphole (stiffer) spring 246*a* from engaging.

FIGS. 5B1 and 5B2 depict operation of the shock assembly 111 as the drill string 103 is subjected to the forces depicted in FIG. 4B. FIG. 5B1 shows a cross-sectional view of the shock assembly 111. FIG. 5B2 shows a portion 5B2 of the shock assembly 111 of FIG. 5B1 in greater detail.

As shown in these figures, the downhole spring portion 232*b* moves a greater distance relative to downhole spacer 244*b* as the housing 222 moves along mandrel 219 toward the first end of the mandrel 219 past spacer 244*b* in response to the greater forces applied thereto. In this position, the shock assembly 111 is in heavy compression, the downhole (softer) spring 246*b* is heavily compressed, and an uphole (or first) end of downhole spring portion 232*b* extends over spacer 244*b* to engage the uphole spring 246*a*.

Figure 6A:
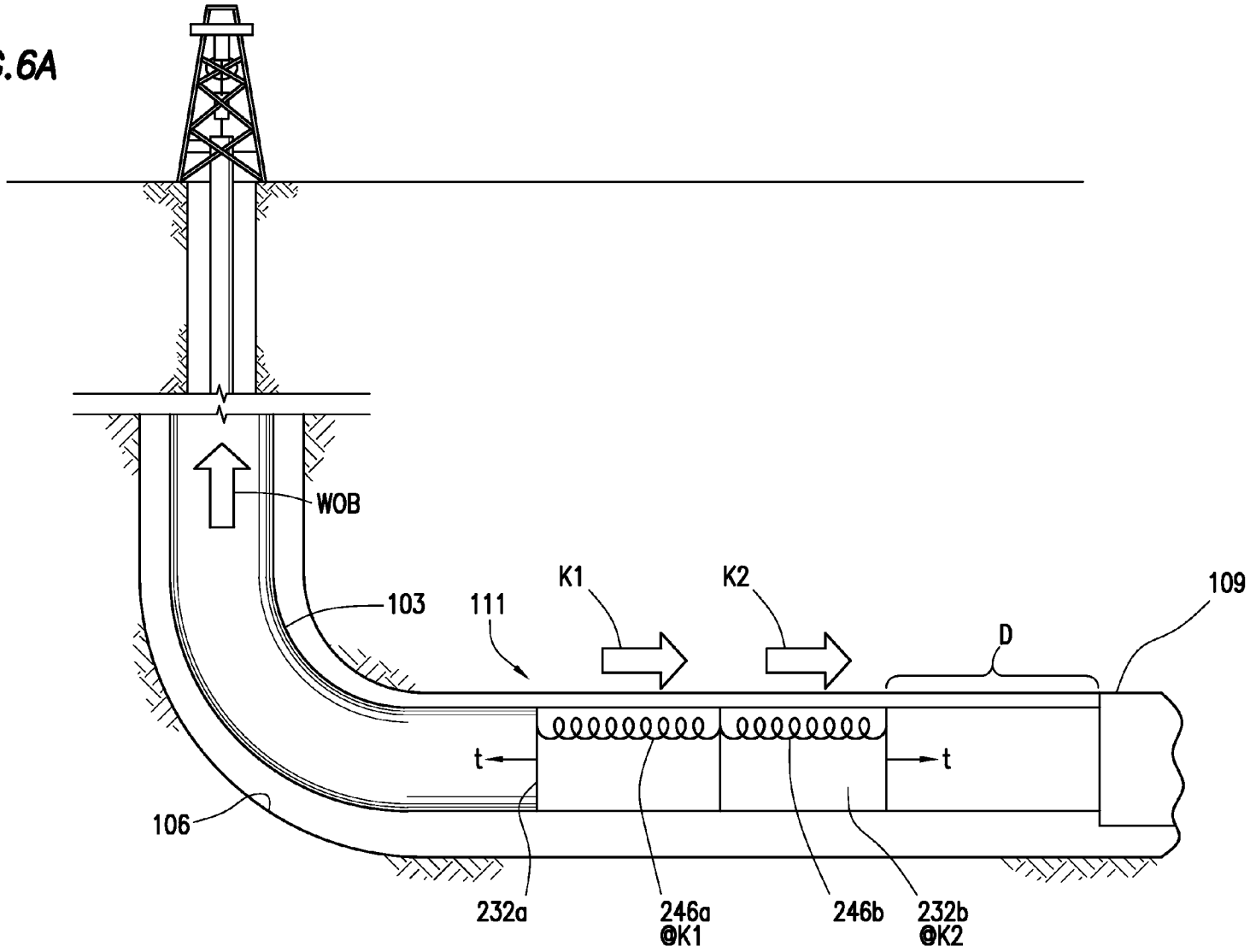
FIGS. 6A and 6B are schematic diagrams depicting forces applied to a drilling tool under tension in horizontal and vertical portions, respectively, of the wellbore.
Figure 6B:
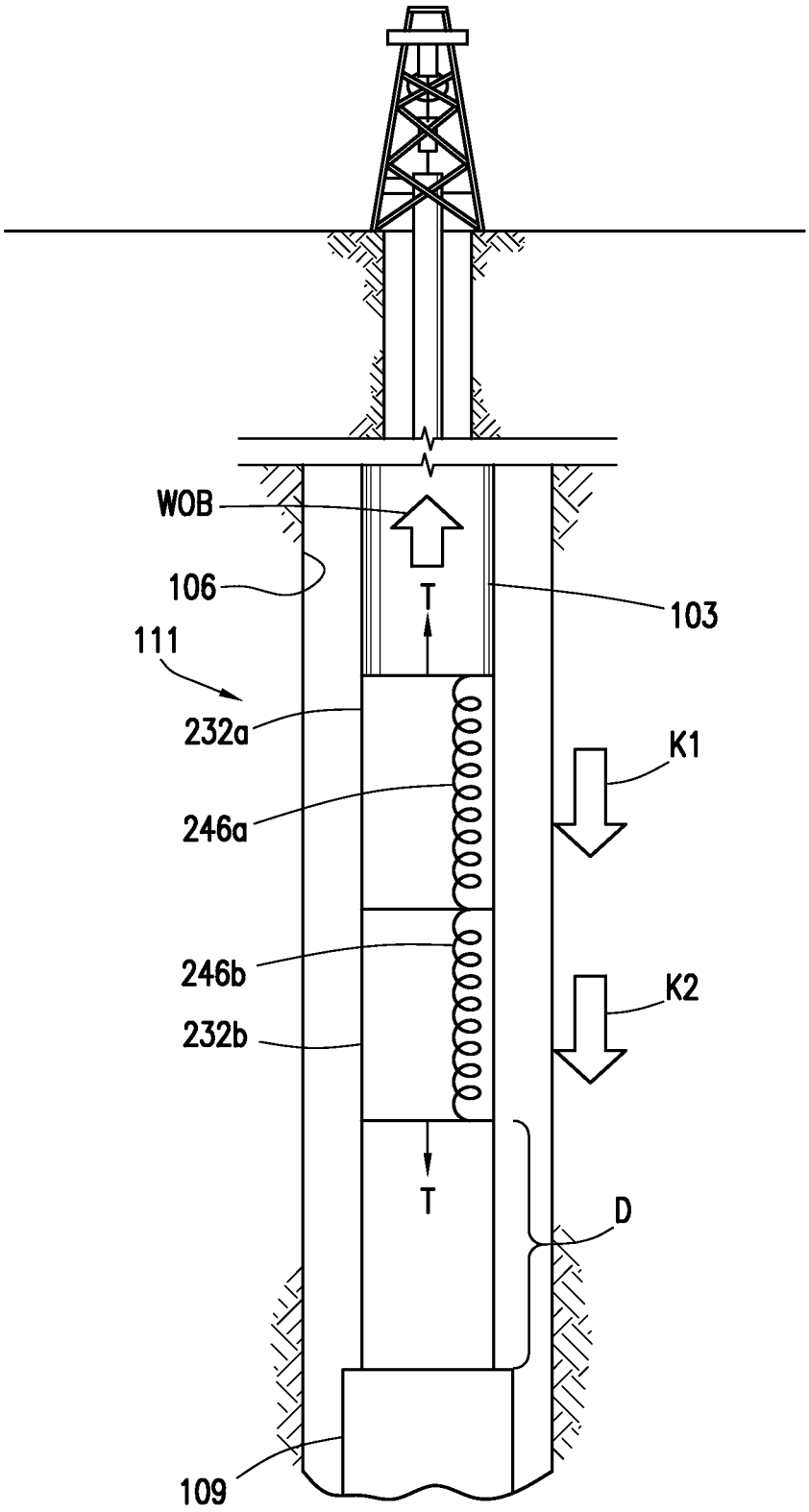

FIGS. 6A-7B2 depict operation of the shock assembly 111 under tension. FIGS. 6A and 6B are schematic diagrams depicting forces on the drill string 103 and on the shock assembly 111 when positioned adjacent the BHA 109 and subject to tensile forces t, T as weight on bit (WOB) is reduced. This may occur, for example, when the shock assembly 111 is positioned a distance D from the BHA 109, or when the BHA 109 is tripped out of the wellbore 106. FIG. 6A shows the shock assembly 111 in a horizontal portion of the wellbore 106. FIG. 6B shows the shock assembly 111 in a vertical portion of the wellbore 106.

FIGS. 6A and 6B show the shock assembly 111 as having the uphole and downhole springs 246*a,b* with spring stiffnesses K1, K2 responding to the WOB. As shown in FIG. 6A, when the shock assembly 111 is subject to WOB in a horizontal portion of the wellbore, a smaller WOB force with light tension t applied thereto. In such cases, the downhole spring 246*b* with stiffness K1 is partially compressed as indicated by the arrow and the uphole spring 246*a* is not engaged.

As shown in FIG. 6B, when the shock assembly 111 is subject to WOB in a vertical portion of the wellbore 106, with heavy tension T applied thereto. In such cases, the uphole spring 246*a* is heavily compressed and the spring stiffnesses K1 and K2 of the uphole spring 246*a* and the downhole spring 246*b* are both engaged as indicated by the arrows.

FIGS. 7A1 and 7A2 depict operation of the shock assembly 111 as the drill string 103 is subjected to the forces depicted in FIG. 6A. FIG. 7A1 shows a cross-sectional view of the shock assembly 111. FIG. 7A2 shows a portion 7A2 of the shock assembly 111 of FIG. 7A1 in greater detail.

As shown in these figures, the uphole spring portion 232*a* moves a distance relative to uphole spacer 244*a* as the housing 222 moves along mandrel 219 toward the second end of mandrel 219 in response to the forces. In this position, the shock assembly 111 is in light tension, the downhole (softer) spring 246*b* is partially compressed, and uphole spacer 244*a* prevents the uphole (stiffer) spring 246*a* from engaging.

FIGS. 7B1 and 7B2 depict operation of the shock assembly 111 as the drill string 103 is subjected to the forces depicted in FIG. 6B. FIG. 7B1 shows a cross-sectional view of the shock assembly 111. FIG. 7B2 shows a portion 7B2 of the shock assembly of FIG. 7B1 in greater detail.

As shown in these figures, the uphole spring portion 232*a* and the extension sleeve 242 move a distance relative to uphole spacer 244*a* as the housing 222 moves along mandrel 219 toward the second end of mandrel 219 in response to the forces. In this position, the shock assembly 111 is in heavy tension, the downhole (softer) spring 246*b* is heavily tensed, and the extension sleeve 242 extends over uphole spacer 244*a* to engage the uphole (stiffer) spring 246*a*.

Figure 8:
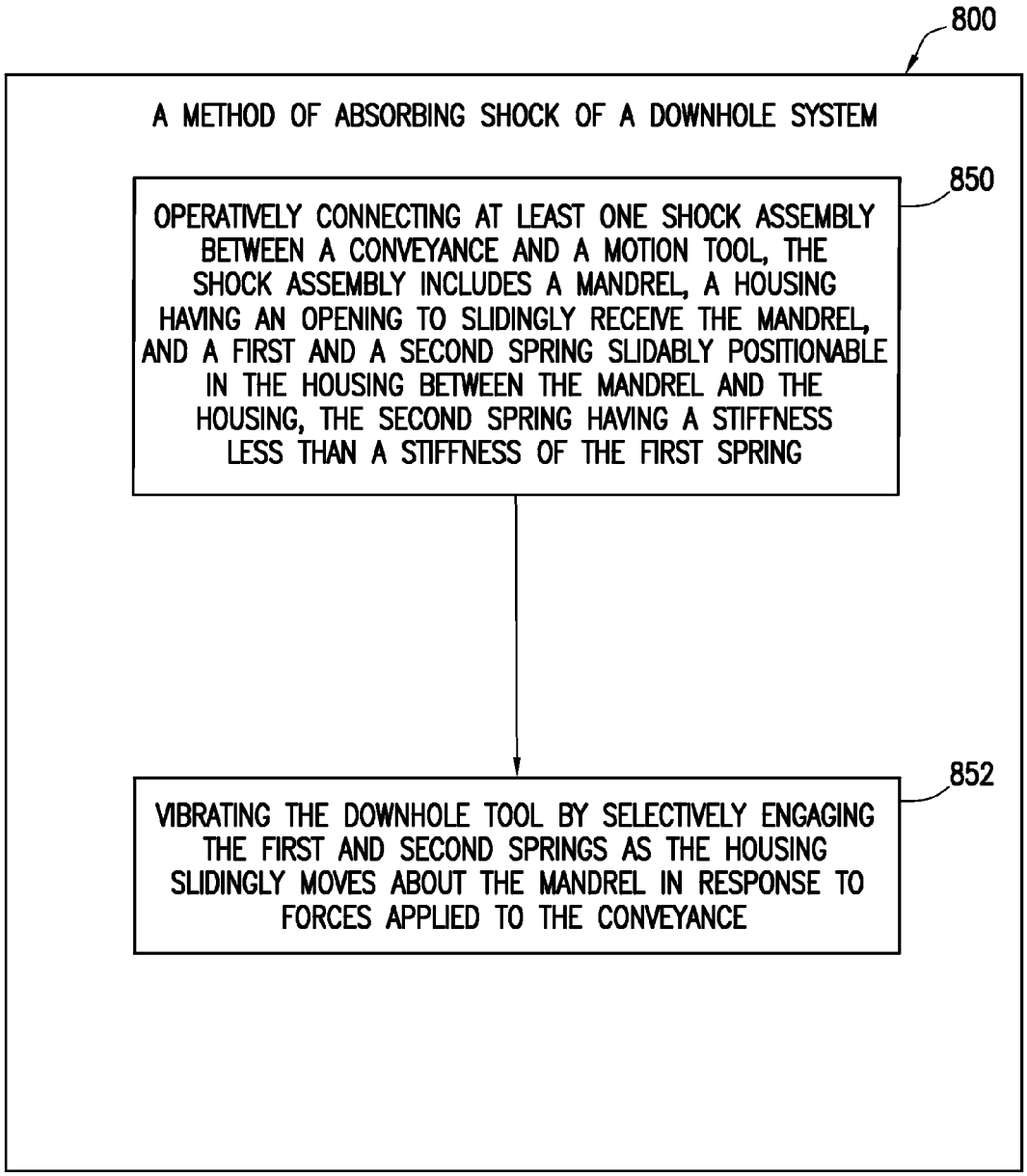
FIG. 8 is a flow chart depicting a method of drilling a wellbore.

FIG. 8 depicts a method (800) of absorbing shock of a downhole system, the downhole system comprising a motion tool deployable into a wellbore penetrating a subterranean formation by a conveyance. The method involves operatively connecting (850) at least one shock assembly between the conveyance and the motion tool. The shock assembly includes a mandrel, a housing having an opening to slidingly receive the mandrel, a first and a second spring slidably positionable in the housing between the mandrel and the housing and selectively engaging as the housing slidingly moves about the mandrel in response to forces applied to the system. The second spring has a stiffness less than a stiffness of the first spring.

The method also involves (852) vibrating the downhole tool by selectively engaging the first and second springs as the housing slidingly moves about the mandrel in response to forces applied to the conveyance. The vibrating may involve engaging the downhole spring and the uphole spring when the force is above a pre-determined minimum, engaging the downhole spring but not the uphole spring when the force is below a pre-determined maximum, engaging the downhole spring when the forces are applied to the drill string, and/or engaging the uphole spring when the forces are sufficient to move the housing to a pre-determined position along the mandrel. The method(s) may be performed in any order and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more shock assemblies and/or motion (e.g., agitator or pulser) tools may be provided with one or more features (e.g., springs, pistons, housings, mandrels, etc.) described herein.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A shock assembly for use with a motion tool deployable into a wellbore penetrating a subterranean formation by a conveyance, the shock assembly comprising:

a mandrel operatively connectable to one of the conveyance and the motion tool;

a housing operatively connectable to another of the conveyance and the motion tool, the housing having an opening to slidingly receive the mandrel; and a first spring and a second spring slidably positionable in the housing between the mandrel and the housing, the first spring having a first spring stiffness and the second spring having a second spring stiffness, the second spring stiffness being less than the first spring stiffness such that the first and second springs selectively engage as the housing slidingly moves in both directions about the mandrel in response to forces applied to the motion tool to selectively restrict movement between the mandrel and the housing whereby the motion tool is vibrated.

2. The shock assembly of claim 1, wherein the second spring is engaged when the forces are applied to the conveyance.

3. The shock assembly of claim 1, wherein the first spring is engageable when the forces are sufficient to move the housing to a pre-determined position along the mandrel.

4. The shock assembly of claim 3, further comprising a compression spacer in the housing between the first spring and the mandrel, the second spring being engageable when a second spring portion of the housing remains a distance from a first end of the compression spacer, the first and second springs being engageable when the second spring portion advances along the mandrel past the compression spacer.

5. The shock assembly of claim 1, further comprising a tension spacer and an extension sleeve in the housing between a splined portion of the housing and the first spring, the second spring engageable when a second spring portion of the housing remains a distance from a second end of the tension spacer, the first and second springs being engageable when the extension sleeve is moved past the tension spacer when the second spring portion of the housing advances along the mandrel toward a second end of the mandrel.

6. The shock assembly of claim 1, wherein the housing and the mandrel each comprise a splined portion, the splined portion of the mandrel receivingly engageable with the splined portion of the housing.

7. The shock assembly of claim 6, further comprising a lock ring positionable between the housing and the mandrel, the lock ring defining a stop for travel of the splined portion along the mandrel.

8. The shock assembly of claim 1, wherein the housing comprising an end cap, a splined portion, a first spring housing, a second spring housing, a balancing sub, and a bottom sub.

9. The shock assembly of claim 1, wherein the mandrel comprises a first portion, a second portion, and a washpipe.

10. The shock assembly of claim 1, wherein a second end of the mandrel is engageable with a balancing sub of the housing to limit travel therebetween.

11. The shock assembly of claim 1, wherein a first portion of the mandrel has a shoulder engageable with a first end of the housing to limit travel therebetween.

12. The shock assembly of claim 1, wherein the conveyance is a drill string and the motion tool is one of a pulsing tool and a vibrating tool.

13. The shock assembly of claim 12, wherein the mandrel is operatively connectable to the drill string and the housing is operatively connectable to the motion tool.

14. The shock assembly of claim 1, wherein the mandrel is operatively connectable to the motion tool and the housing operatively connectable to the conveyance.

15. The shock assembly of claim 1, wherein the housing moves along the mandrel upon a pressure differential between pressure in a passage in the shock assembly and pressure outside of the housing.

16. A system for use in a wellbore penetrating a subterranean formation, the system comprising:

a conveyance deployable into the wellbore;

at least one motion tool operatively connectable to the conveyance; and at least one shock assembly operatively connectable between the conveyance and the at least one motion tool, the at least one shock assembly comprising:

a mandrel operatively connectable to one of the conveyance and the motion tool;

a housing operatively connectable to another of the conveyance and the at least one motion tool, the housing having an opening to slidingly receive the mandrel; and a first spring and a second spring slidably positionable in the housing between the mandrel and the housing;

a first spacer and a second spacer disposed in the housing between the mandrel and the housing, the first spacer configured to contact one of the first and second springs and the second spacer configured to contact the same one of the first and second springs;

the first spring having a first spring stiffness and the second spring having a second spring stiffness, the second spring stiffness being less than the first spring stiffness such that the first and second springs selectively engage as the housing slidingly moves about the mandrel in response to forces applied to the system to selectively restrict movement between the mandrel and the housing whereby the motion tool is vibrated.

17. A method of vibrating a motion tool positionable in a wellbore penetrating a subterranean formation by a conveyance, the method comprising:

operatively connecting a shock assembly between the conveyance and the motion tool, the shock assembly comprising a mandrel, a housing having an opening to slidingly receive the mandrel and comprising a first spring portion and a second spring portion, a first and a second spring slidably positionable in the housing between the mandrel and the housing, the second spring having a stiffness less than a stiffness of the first spring; and vibrating the motion tool by selectively engaging the first and second springs as the housing slidingly moves in both directions about the mandrel in response to forces applied to the conveyance.

18. The method of claim 17, wherein the conveyance comprises a drill string with a bit at a downhole end thereof, the method further comprising advancing the drill bit into the subterranean formation to form the wellbore.

19. The method of claim 17, wherein the vibrating comprises engaging the second spring and the first spring when the forces are above a pre-determined minimum.

20. The method of claim 17, wherein the vibrating comprises engaging the second spring but not the first spring when the forces are below a pre-determined maximum.

21. The method of claim 17, wherein the vibrating comprises engaging the second spring when the forces are applied to the conveyance.

* * * * *